US009217564B2

(12) United States Patent
Liu et al.

(10) Patent No.: US 9,217,564 B2
(45) Date of Patent: Dec. 22, 2015

(54) SATURATED WATER GENERATING DEVICE

(71) Applicant: TAIZHOU DAJIANG INDUSTRY CO., LTD., Taizhou (CN)

(72) Inventors: Guiwen Liu, Taizhou (CN); Mingjun Yang, Taizhou (CN); Jinquan Huang, Taizhou (CN)

(73) Assignee: TAIZHOU DAJIANG INDUSTRY CO., LTD., Taizhou, Zhejiang (CN)

( * ) Notice: Subject to any disclaimer, the term of this patent is extended or adjusted under 35 U.S.C. 154(b) by 71 days.

(21) Appl. No.: 14/161,704

(22) Filed: Jan. 23, 2014

(65) Prior Publication Data

US 2015/0198328 A1 Jul. 16, 2015

(30) Foreign Application Priority Data

Jan. 10, 2014 (CN) ..... 2014 1 0012022

(51) Int. Cl.

| | |
|---|---|
| ***F22B 27/16*** | (2006.01) |
| ***F22B 29/06*** | (2006.01) |
| ***F22B 3/00*** | (2006.01) |
| ***F22B 3/08*** | (2006.01) |
| ***F22B 15/00*** | (2006.01) |

(52) U.S. Cl.

CPC ..... *F22B 29/061* (2013.01); *F22B 3/00* (2013.01); *F22B 3/08* (2013.01); *F22B 15/00* (2013.01)

(58) Field of Classification Search

CPC ..... B01D 1/22

USPC ..... 122/92, 188, 191, 215, 39, DIG. 10, 122/DIG. 11

See application file for complete search history.

(56) References Cited

U.S. PATENT DOCUMENTS

| | | | | |
|---|---|---|---|---|
| 4,352,252 | A * | 10/1982 | Brenot | 38/16 |
| 5,279,262 | A * | 1/1994 | Muehleck | 122/26 |
| 5,419,306 | A * | 5/1995 | Huffman | 126/247 |
| 5,989,437 | A * | 11/1999 | Eriksson et al. | 210/744 |
| 8,495,973 | B2 * | 7/2013 | Poshusta et al. | 122/39 |
| 8,528,649 | B2 * | 9/2013 | Kolle | 166/373 |
| 2013/0270352 | A1 * | 10/2013 | Roth et al. | 237/12.3 B |

* cited by examiner

*Primary Examiner* — Gregory A Wilson

(74) *Attorney, Agent, or Firm* — Locke Lord LLP; Tim Tingkang Xia, Esq.

(57) ABSTRACT

A saturated water generating device includes a thermal receptor including a cavity inside, a liquid entrance connected into the cavity of the thermal receptor, a heat source, and a pillar disposed in the cavity of the thermal receptor. The heat source is used to heat the cavity of the thermal receptor. The pillar includes a plurality of tiny channels. The liquid is heated to generate saturated water in the tiny channels. Through the saturated water generating device, the high-temperature and high-pressure saturated water is generated by heating the high-pressure water, and then make the generated high-temperature and high-pressure saturated water explore instantly when it is heated, and then quickly intensive evaporation and formation of high-temperature and high-pressure steam flow as the power source.

1 Claim, 2 Drawing Sheets

SATURATED WATER GENERATING DEVICE

BACKGROUND OF THE INVENTION

1. Field of the Invention

The invention relates to steam power, and more particularly to a saturated water generating device.

2. Description of Related Art

For engine, the traditional gasoline engine and diesel engine not only generate harmful gas, but about 50% fuels are transformed into engine overheating heat during the process of burning. When this kind of engine is applied to crankshaft, camshaft and valve, it is required higher technique and cause much higher costs as well as increasing of abrasion and weight, etc. Therefore, the power-source device of transforming steam heat into mechanical power is adopted to install in engine nowadays, in order to manufacture piston-style steam engine and steam turbine engine. For piston-style steam engine, it is already gradually eliminated because low efficiency of heat conversion and environment pollution; and the steam turbine engine is widely used in thermal power plants. Nevertheless, there is not the method and device of using the high-temperature and high-pressure vapor steam generated by saturated water explosion, and therefore it is necessary to study this field and design a new steam power device.

SUMMARY OF THE INVENTION

The technical problem to be solved by the invention is to provide a saturated water generating device, so as to enable generating power by using high-temperature water to explore and expand when it is heated instantly.

In order to resolve the problem, the saturated water generating device of the invention, includes thermal receptor with a cavity inside, entrance of liquid connected into the cavity of the thermal receptor, heat source and pillar set in the cavity of the thermal receptor; the heat source is used to heat the cavity of the thermal receptor; the pillar is set with tiny channels, and the liquid is heated to generate saturated water in the tiny channels.

The tiny channel includes the gap between the outer surface of the pillar and the inner surface of the thermal receptor, and/or at least one thin groove on the outer surface of the pillar.

The width of the gap is less than 1 mm.

The width of the thin groove is less than 1 mm and the depth of the thin groove is less than 1 mm.

The saturated water generating device further includes split-flow device, and the split-flow device is set with the channel connecting the gap and/or thin groove with the entrance of high-pressure liquid.

The saturated water generating device further includes thermal conductor, and the thermal conductor is located on the end close to the high-pressure liquid of the pillar, and used to strengthen the saturated water heated and heat balance.

Through the saturated water generating device of the invention, the high-temperature and high-pressure saturated water is generated by heating the high-pressure water, and then make the generated high-temperature and high-pressure saturated water explore instantly when it is heated, as the power source. The power source generated through the method has many advantages compared to the existing fuel internal combustion engine:

1. The type and quality of fuel is not strictly required, as long as there are qualified heat source to provide to a temperature of 400° C., and thermal energy conversion efficiency is high. Experiments show that thermal energy conversion efficiency is more than 25% to 35%, higher than about 20% of the existing internal combustion engines.

2. The scope of applicable engine is enlarged, and the exhaust noise of the device is largely decreased than that of fuel internal combustion engine, and characteristic of torque is good, and even may not be required to install the gearbox to enable the automobile continuously variable speed when transportation power output, and less harmful ingredient of the exhausted gas.

3. Simple structure of the device of the invention, light weight, small size and easy to move.

The above and other objects, features and advantages of the invention will become apparent from the following detailed description taken with the accompanying drawings.

DETAILED DESCRIPTION OF THE INVENTION

To enable those skilled in the art better understand the technical solution of the invention, the following embodiments of the invention will be further described in detail.

Figure 1:
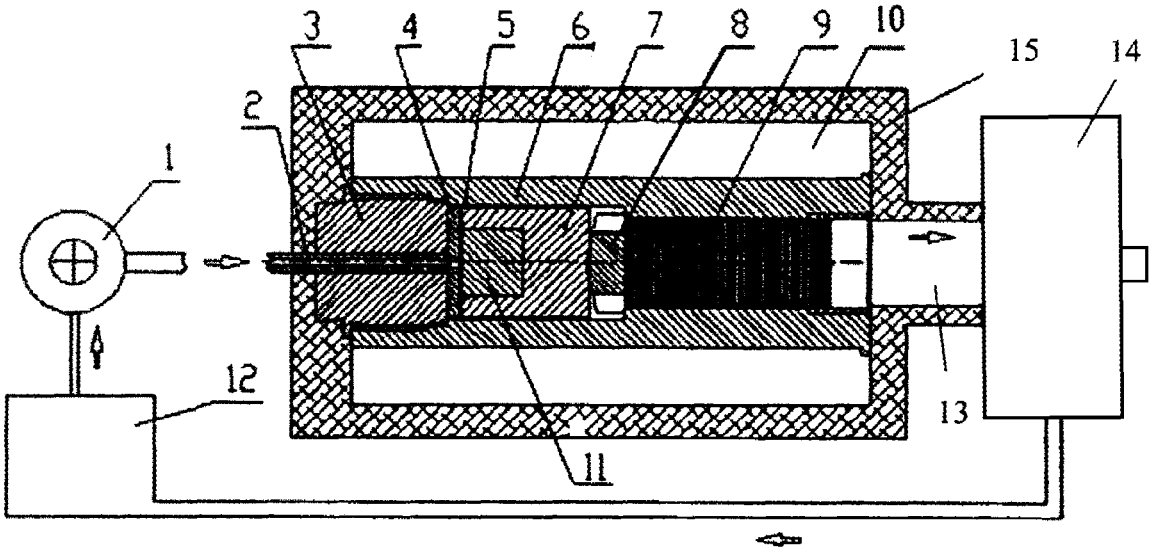
FIG. 1 is the whole structure schematic diagram of the steam power generating system of the invention.

Referring to FIGS. 1 to 5, a steam power generating system of the invention comprises a saturated water generating device and a saturated water explosive device. As shown in FIG. 1, the system includes inflow pipe 2, screw-plug 3, split-flow piece 4, obstruct-flow piece 5, thermal receptor 6, pillar 7, base 8, heat resource 10 and thermal conductor 11.

The inflow pipe 2 is embedded into the screw-plug, and the screw-plug is connected with the thermal receptor 6 by the screw thread, and meanwhile generates preload pressure to the split-flow piece 4 and the obstruct-flow piece 5, and the other side of the obstruct-flow piece 5 is connected with the thermal conductor 11. The thermal conductor is embedded inside the pillar 7, and also can adhere tightly outside the pillar 7 certainly. The other side of the pillar 7 is connected with the base 8, and the base 8 is connected with the shoulder on the inner wall of the thermal receptor 6 so as to play support effect. The outside of the thermal receptor 6 is set with heat resource 10.

Figure 2:
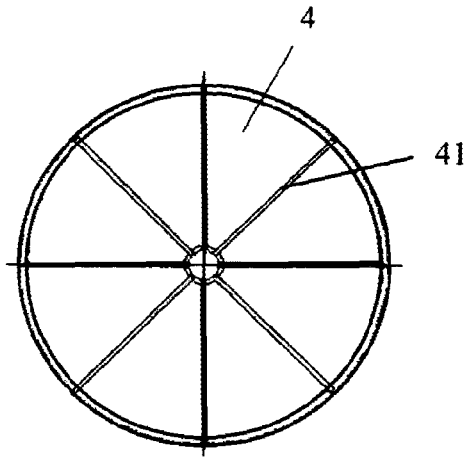
FIG. 2 is the structure schematic diagram of the split-flow piece of the saturated water generating device of the invention.
Figure 3:
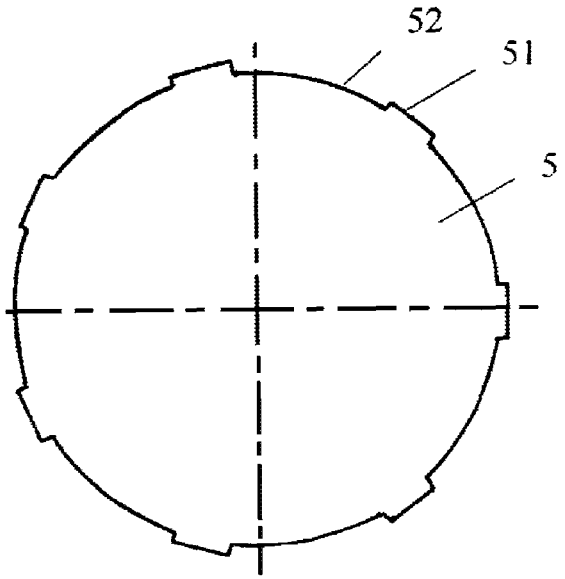
FIG. 3 is the structure schematic diagram of the obstruct-flow piece of the saturated water generating device of the invention.

As shown in FIGS. 2 and 3, the split-flow piece 4 is set with several liquid-connecting groove 41, and the high-pressure liquid enters the liquid-connecting groove 41 through the inflow pipe 2.

The obstruct-flow 5 is contacted with the split-flow piece 4, and there are several outward convex 51 and concave 52 on the periphery of it. The out edge of sad convex 51 props on the inner wall of the thermal receptor 6, and the liquid inside the liquid-connecting groove can enter the side of the pillar 7 through the concave 52. The tiny channels are set between the pillar 7 and the thermal receptor 6, and inside the tiny channels, the high-pressure water is heated to generate high-temperature saturated water. The tiny channel includes the gap 71 between the outer surface of the pillar 7 and the inner surface of the thermal receptor 6, and the width of the gap is less than 1 mm.

Alternatively, the tiny channel includes the several thin groove 72 on the outer surface of the pillar 7, and the width of the thin groove is less than 1 mm and the depth of it is less than 1 mm. Certainly, the tiny channel can also includes the gap 71 and the thin groove 72 meantime, and it has been proved by many experiments over and over again that the effect of generating steam of the system is the best when the tiny channel includes the gap 71 and the thin groove 72 meantime along with the gap 71 is less than 1 mm.

The high-pressure liquid enters the inflow pipe 2 through the liquid pump 1, split by the split-flow piece 4, obstructed by the obstruct-flow piece 5, and then enters the tiny channel and heated in the narrow space of the tiny channel to form high-temperature and high-pressure saturated water. After formed, the high-temperature and high-pressure saturated water is sprayed out from the tiny channel by high pressure and then forms tiny saturated water particles and hit the high-temperature stated saturated water explosive device and then occurs water explosion, quickly intensive evaporation and formation of high-temperature and high-pressure steam.

The saturated water explosive device includes porous material body 9, and the porous material body is placed inside the cavity of the thermal receptor 6 and placed on the end close to the steam exit 13. The porous material body 9 may be net structure. The outer side of the steam exit 13 is connected with power conversion device 14, and can be cylinder or steam turbine to work outwardly to generate power output. The outside of the thermal receptor 6 is heat source 10, and the heat source 10 can be heat energy generated by burning fuels and can be waste heat energy with suitable temperature, and can be heat energy saved by phase-changed heat accumulator, etc. The outside of the heat resource can be covered by thermal insulation layer 15. The screw-plug 3 is connected with the thermal receptor 6 by screw thread, and meantime generates preload pressure to the split-flow piece 4 and the obstruct-flow piece 5, and it is locked tightly and sealed between the end surface of the screw-plug and the thermal receptor 6. The effect of the split-flow piece 4 is radial direction splitting and preheating.

Figure 4:
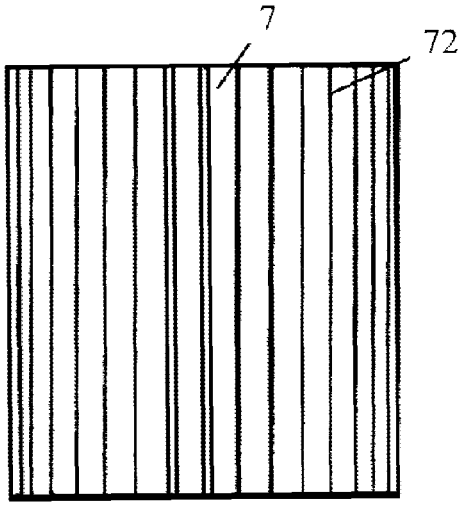
FIG. 4 is the structure schematic diagram of the pillar of the saturated water generating device of the invention.
Figure 5:
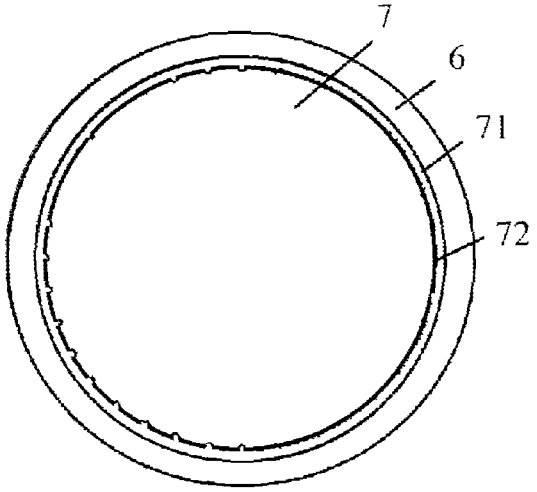
FIG. 5 is the assembling structure schematic diagram of the pillar and the thermal receptor of the saturated water generating device of the invention.

The pillar 7 and the thermal conductor 11 are adjacent to the obstruct-flow piece 5, and the pillar is solid or porous sintered material, and the material is high-temperature resistant, corrosion resistant and heat resistant steel material. The outer surface of the pillar 7 is set several or tens of thin grooves of radial distribution or axial distribution as shown in FIG. 4. The thermal conductor can be embedded into the pillar 7, and can also be outside of the pillar 7 independently, and is made of material with excellent high-temperature resistant and corrosion resistant. Since the end close to obstruct-flow piece 5 of the pillar 7 is contacted with high-pressure liquid first, the heat is absorbed quickly by the high-pressure liquid, leading to drop of its own temperature. So effect of setting of the thermal conductor 11 is to enhance heat conduction and enable heat of the pillar 7 can be supplemented quickly after the drop of the temperature and assure the steam dynamic generated by every pulse is smooth and steady. The base 8 along with the shoulder contact on the inner wall of the thermal receptor 6 plays support effect, and the porous material 9 is made of heat-resistant and anti-high-temperature-oxidative materials.

It is also set the undercooling device 12 before the entrance of the high-pressure liquid, and the undercooling device 12 is connected with power conversion device 14, so as to cyclic utilization of the liquid.

The invention disclosed a method of generating steam power, which includes the steps as follows: making high-pressure liquid generate high-temperature saturated water; making the high-temperature saturated water explode instantly when heated, so as to form the high-temperature and high-pressure steam flow.

We all know the process of vaporization of water, for instance, putting 1 kg, 0° C. water into the container with piston, and heating the container from outside, and keeping the pressure inside the container is p invariantly. At the beginning, the temperature of the water is gradually increasing, and the volume is increased slightly. But after the temperature is risen to ts corresponding to the saturated temperature of p and the water converted to saturated water, keep heating, then the saturated water changed gradually into saturated steam, i.e., so-called vaporization, until the ending of vaporization. During the whole process of vaporization, the temperature is kept at the saturated temperature ts. During the process of vaporization, the specific volume usually increased a lot due to the increasing volume of the saturated water. Keeping heating, the temperature begins to increase again, and the specific volume is continuously increased, and the saturated steam is converted into overheating steam. When water meets the high-temperature object, the explosion occurred. Due to the saturated water is in the high-temperature saturated state (critical pressure pc is 22.064 MPa, critical temperature tc is 373.99° C.), with the stronger ability of vaporization compared with unsaturated water, less absorption of heat, faster vaporization, and can generate high-temperature and high-pressure steam flow when exploded instantly. And for steam, it only expanded when heated, not exploded when meeting with high-temperature objects.

Although the invention has been described in detail, it is to be understood that this is done by way of illustration only and is not to be taken by way of limitation. The scope of the invention is to be limited only by the appended claims.

What is claimed is:

1. A saturated water generating device, comprising:

a thermal receptor comprising a cavity filled with liquid, a liquid entrance connected to the cavity, a heat source for heating the cavity, and a pillar disposed in the cavity, the pillar including a plurality of tiny channels each having a gap between an outer surface of the pillar and an inner surface of the thermal receptor, and at least one groove on the outer surface of the pillar wherein the liquid is heated to generate saturated water in the tiny channels;

a split-flow device comprising a channel connecting the gap and the at least one groove to the liquid entrance; and a thermal conductor disposed on an end proximate to the pillar, the thermal conductor configured to further heat the saturated water.

* * * * *